US005092784A

United States Patent [19]

de Mendez et al.

[11] Patent Number: 5,092,784

[45] Date of Patent: Mar. 3, 1992

[54] CONNECTOR COMPONENT FOR CONNECTING A COAXIAL CABLE TO CONTACT PINS, AND AN ASSEMBLY OF SUCH CONNECTOR COMPONENTS

[75] Inventors: Michel de Mendez, Monthlery; Jean Riverie, Epinay-Sous-Senart, both of France

[73] Assignee: Souriau & Cie, Versailles, France

[21] Appl. No.: 717,008

[22] Filed: Jun. 18, 1991

[30] Foreign Application Priority Data

Jun. 18, 1990 [FR] France ..... 90 07565

[51] Int. Cl.[5] ..... H01R 13/00

[52] U.S. Cl. ..... 439/161; 439/578

[58] Field of Search ..... 439/161, 578–585

[56] References Cited

U.S. PATENT DOCUMENTS 1,603,379 10/1926 Gagnon ..... 439/161
3,538,240 11/1970 Sherlock ..... 439/161
3,740,839 6/1973 Otte et al. ..... 439/161

FOREIGN PATENT DOCUMENTS 2323666 9/1975 Austria .
0161952 10/1986 European Pat. Off. .
0197821 10/1986 European Pat. Off. .
0341535 11/1989 European Pat. Off. .

*Primary Examiner*—Joseph H. McGlynn
*Attorney, Agent, or Firm*—Pollock, Vande Sande & Priddy

[57] ABSTRACT

A connector component for connecting a coaxial cable comprising a central core and an outer braid to respective first and second contact pins, wherein the connector component is constituted by a core ferrule and a ground ferrule each made of a conductive material having shape memory and shaped so as to fit closely, when in a first shape memory state, respectively on the central core and on the outer braid, and so as to be able to engage and/or disengage the core and ground ferrules when in a second shape memory state, the core and ground ferrules being respectively connected to first and second sockets for providing electrical connection and mechanical cohesion respectively with the first contact pin and the second contact pin. The invention is applicable to electrical connections.

9 Claims, 2 Drawing Sheets

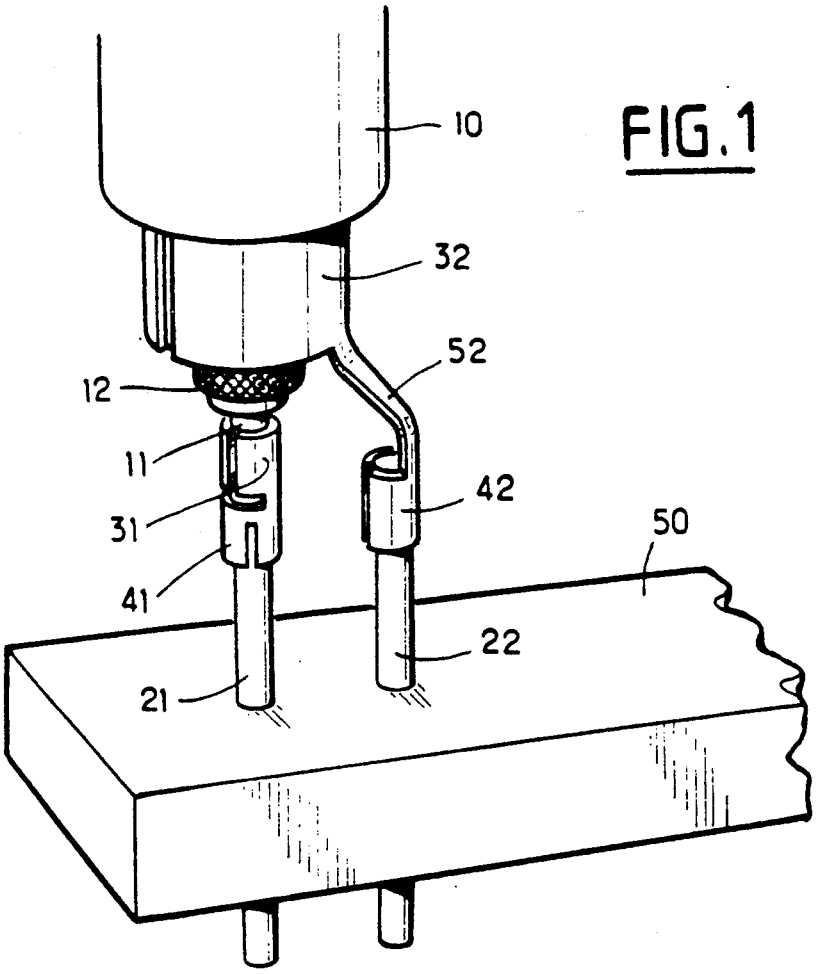
FIG. 1
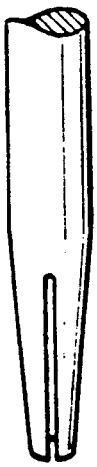
FIG. 2
FIG. 3
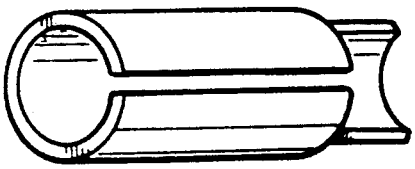

CONNECTOR COMPONENT FOR CONNECTING A COAXIAL CABLE TO CONTACT PINS, AND AN ASSEMBLY OF SUCH CONNECTOR COMPONENTS

The present invention relates to a connector component for connecting a coaxial cable comprising a central core and an outer braid to respective first and second contact pins. It also relates to an assembly of such connector components.

The invention is advantageously applicable to the general technology of electrical connections.

BACKGROUND OF THE INVENTION

It is relatively difficult to make an electrical connection between a coaxial cable and contact pins such as those constituting the rear portions of a connector contact passing through a card, for example. Although it is relatively easy to connect the central core of the cable to one of the contact pins by soldering or by crimping, connecting the ground braid to a second contact pin is much less easy since it is necessary not only to strip the cable but also to unbraid the strands of the braid and then bring them together to constitute a single conductor which must then be soldered to said second pin or else a short length of auxiliary conductor must be soldered to the braid. This gives rise to manipulation that is fiddly and expensive in time and provides a result that is barely satisfactory. In addition, a connection made in this way does not lend itself easily to frequent assembly and disassembly operations.

Thus, the technical problem to be solved by the present invention is to provide a connector component as defined in the preamble, which can be implemented easily, quickly, and reliably, and which is also suitable for connection and disconnection as often as may be necessary without excessive wear.

SUMMARY OF THE INVENTION

According to the present invention, the solution to the technical problem posed consists in said connector component being constituted by a core ferrule and a ground ferrule each made of a conductive material having shape memory and shaped so as to fit closely, when in a first shape memory state, respectively on said central core and on said outer braid, and so as to be able to engage and/or disengage said core and ground ferrules when in a second shape memory state, the core and ground ferrules being respectively connected to first and second sockets for providing electrical connection and mechanical cohesion respectively with said first contact pin and said second contact pin.

Thus, the connector component of the invention comprises two portions, a core ferrule and a ground ferrule which are easily connectable respectively to the central core and to the outer braid once the cable has been stripped. Tho do this, it is merely necessary to cool the ferrules below the transition temperature of the shape memory conductive material, i.e. into its martensitic phase, to engage the ferrules respectively on the core and on the braid, and then to cause the material to pass into its austenitic phase by increasing the temperature, whereupon the shape memory effect causes the core and braid ferrules to return to their first shape state, i.e. the state which ensures good electrical and mechanical contact. To detach the connector component of the invention from the coaxial cable, the ferrules should be again cooled to a temperature below the transition temperature so that they take up the martensitic state, after which they can be taken off the central core and the outer braid. In the operating state, above the transition temperature, a coaxial cable has thus been provided with ferrules in a manner which is very simple and quick and which does not require the application of force. In addition, the ferrules can be installed and removed at will and they are terminated by sockets that are easily connected to contact pins.

In a particular embodiment of the connector component of the invention, provision is made for at least one of said sockets to be made of a conductive material having shape memory and shaped so as to fit tightly when in a first shape memory state on one of said contact pins and to be capable of engaging and/or disengaging said pin when in a second shape memory state. In this way, after the core and the braid have been engaged respectively in the core ferrule and in the ground ferrule, and after the contact pins have been installed in the sockets, all the operations taking place below the lower transition temperature, the temperature is increased, thereby bringing the various parts of the shape memory connector component into their first shape memory state which corresponds to optimum contact. Naturally, if the shape memory materials constituting the connector components of the invention are different, then it would be appropriate for all of the materials to be in the austenitic phase at the operating temperature, e.g. ambient temperature, so that all of the shape memory parts are in their first shape memory states. In contrast, the martensitic transition temperatures could then be different so as to make it possible, if necessary, to disengage the sockets from the contact pins without simultaneously disengaging the core and braid ferrules. In this case, the martensitic transition temperature of the ferrules should be lower than that of the sockets.

According to an advantageous feature of the invention, the component is changed reversibly from its first shape memory state to its second shape memory state merely by going through the transition temperature of said shape memory material, regardless of whether the material in question is that constituting the ferrules or, where applicable, the sockets.

Finally, a set of connector components of the invention is remarkable in that the first and second sockets are held in a common insulating housing. This disposition provides the various connector components with the structural interdependence necessary for making said assembly easy to use.

BRIEF DESCRIPTION OF THE DRAWINGS

Embodiments of the invention are described by way of example with reference to the accompanying drawings, in which:

FIG. 1 is a perspective view of a connector component of the invention.

FIG. 2 is a perspective view of a split socket used in the invention.

FIG. 3 is a perspective view of a spring socket used in the invention.

DETAILED DESCRIPTION

Figure 4:
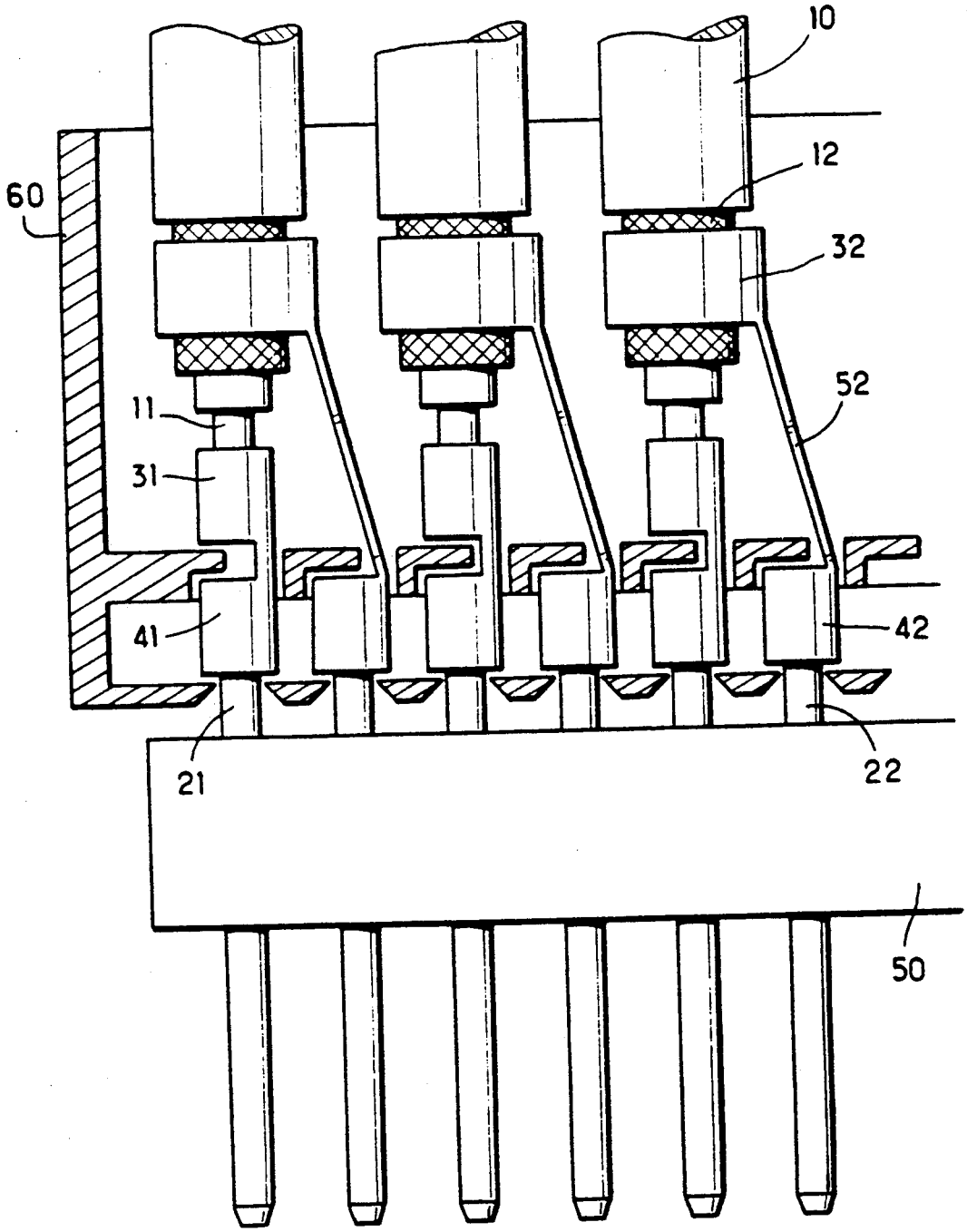
FIG. 4 is an elevation view of a set of connector components of the invention held in an insulating housing.

FIG. 1 is a perspective view of a connector component for interconnecting a coaxial cable 10 and first and second contact pins 21 and 22. The coaxial cable 10 has a central core 11 and an outer braid 12. In the example shown in FIG. 1, the core 11 and the braid 12 are to be connected respectively to contact pins 21 and 22. These contract pins may be rear portions of a contact passing through a card 50 or they may be through pins of the pressfit type or they may be pins for soldering.

The connector component of FIG. 1 is constituted by a core ferrule 31 and a ground ferrule 32 each of which is made of a conductive material having shape memory and shaped so as to be capable of fitting tightly in a first shape memory state respectively on said central core 11 and on said outer braid 12, while enabling said core and ground ferrules to be engaged and/or disengaged while in a second shape memory state. In general, the ferrules 31 and 32 take up their first memory states while in the austenitic phase and at the operating temperature of the connector component, i.e. at ordinary ambient temperature, for example. The ferrules are caused to take up their second shape memory states to enable them to be engaged or disengaged relative to the core 11 and the braid 12 of the coaxial cable 10 by lowering their temperatures to below the martensitic phase transition temperature of the shape memory material. The core ferrule 31 and the ground ferrule 32 can be disengaged while they are in the martensitic state by exerting a small force, either manually or else by using a resilient return member whose action is reversed and overcome by the shape memory effect on returning to the austenitic phase.

However, it is advantageous for said disengagement to be achieved with zero force on passing from the first shape memory state to the second in reversible manner merely by giving through the transition temperature of the conductive material having shape memory. This type of operation requires the core and ground ferrules to be subjected to the education method described in European patent application No. 86 400 560.8 with the general principles thereof being given in European patent application No. 85 400 523.8.

As shown in FIG. 1, the core and ground ferrules are connected respectively to first and second sockets 41 and 42 for providing electrical connection and mechanical cohesion respectively with said first and second contact pins 21 and 22. In the example of FIG. 1, the socket 41 is directly connected to the core ferrule 31 whereas the socket 42 is connected to the ground ferrule 32 via a connecting tab 52.

In a first embodiment, the sockets 41 and 42 are split type sockets as shown in FIG. 2 each including a slit that extends over a portion only of its length. The material from which the split sockets are made may be different from the shape memory material from which the ferrules are made, but for purposes of simplification, it is preferable to use the same material.

In a second embodiment, the sockets 41 and 42 are made of a conductive material having shape memory, and they are shaped so as to be capable, when in a first shape memory state, of fitting closely on one of said contact pins 21 and 22, and while in a second shape memory state, of engaging and/or disengaging said pins 21 and 22. Identical shape memory material may be used for making the core and ground ferrules 31 and 32 and also for making the sockets 41 and 42, in which case the engagement and disengagement operations take place at the same temperature for all of the parts of the connector components, i.e. for the ferrules and for the sockets. Naturally, said shape memory materials could be different, i.e. they could have different transition temperatures, in which case it is possible to dissociate, if so desired, the engagement and disengagement operations applicable to the ferrules from those applicable to the sockets.

As for the core and ground ferrules, the sockets 41 and 42 may, in non-limiting manner, be changed reversibly from their first shape memory state to their second shape memory state merely by being taken through the transition temperature of the shape memory material.

In addition, FIG. 1 shows that the ferrules 31 and 32 and optionally also the sockets, and in this case the socket 42, may each be constituted in a first shape memory state by a substantially tubular part having a slot extending substantially along its entire length. A socket of this type referred to as a "spring socket" is shown in FIG. 3. This particular way of implementing the active portions of the ferrules and of the sockets, and also the corresponding education method are described in detail in European patent application No. 86 400 560.8.

FIG. 4 shows a set of connector components analogous to the component shown in FIG. 1, for use in connecting a plurality of pairs of contact pins 21, 22 to a plurality of coaxial cables 10. As can be seen in FIG. 4, provision is then made for the sockets 41 and 42 to be held in a common insulating housing 60 so as to enable all of the connector components to be installed and handled together.

Examples of shape memory materials suitable for use in implementing the present invention are now given. The shape memory material is preferably selected from the following group of compounds: nickel-titanium, nickel-aluminum, nickel-titanium-iron, copper-zinc-aluminum, and copper-aluminum-nickel; in alloy form or in inter-metallic compound form. By way of non-limiting example, a connector component of the present invention has been made using an alloy comprising substantially 4% aluminum, 28% zinc, and the remainder copper, with the percentages being by weight. The transition temperature with this type of alloy is around −80° C.

We claim:

1. A connector component for connecting a coaxial cable comprising a central core and an outer braid to respective first and second contact pins, wherein said connector component is constituted by a core ferrule and a ground ferrule each made of a conductive material having shape memory and shaped so as to fit closely, when in a first shape memory state, respectively on said central core and on said outer braid, and so as to be able to engage and/or disengage said core and ground ferrules when in a second shape memory state, the core and ground ferrules being respectively connected to first and second sockets for providing electrical connection and mechanical cohesion respectively with said first contact pin and said second contact pin.

2. A connector component according to claim 1, wherein the component is changed reversibly from its first shape memory state to its second state memory state merely by going through the transition temperature of said conductive material having shape memory.

3. A connector component according to claim 1, wherein at least one of said sockets is a split socket.

4. A connector component according to claim 1, wherein each of said ferrules is constituted in said first state memory state by a substantially tubular part including a slot extending substantially along its entire length.

5. A connector component according to claim 1, wherein each of said sockets is constituted in said first shape memory state by a substantially tubular part including a slot extending substantially along its entire length.

6. A connector component according to claim 1, wherein it is all made of the same conductive material having shape memory.

7. A set of connector component according to claim 1, wherein the first and second sockets are held in a common insulating housing.

8. A connector component according to claim 1, wherein at least one of said sockets is made of a conductive material having shape memory and shaped so as to fit tightly, when in a first shape memory state, on one of said contact pins and to be capable of engaging and/or disengaging said pin when in a second shape memory state.

9. A connector component according to claim 8, wherein the component is changed reversibly from its first shape memory state to its second shape memory state merely by going through the transition temperature of said shape memory material.

* * * * *